US009027711B2

(12) United States Patent
Lonergan et al.

(10) Patent No.: US 9,027,711 B2
(45) Date of Patent: May 12, 2015

(54) SELF-LOCKING BI-FOLDABLE LOAD BEARING SEGMENT

(75) Inventors: Brendan Lonergan, Cumberland, WI (US); Michael R. Furseth, Cumberland, WI (US); Randy L. Schamberger, Cumberland, WI (US)

(73) Assignee: Ardisam, Inc., Cumberland, WI (US)

( * ) Notice: Subject to any disclaimer, the term of this patent is extended or adjusted under 35 U.S.C. 154(b) by 399 days.

(21) Appl. No.: 13/222,898

(22) Filed: Aug. 31, 2011

(65) Prior Publication Data

US 2013/0048429 A1 Feb. 28, 2013

(51) Int. Cl.

| | |
|---|---|
| ***E06C 1/00*** | (2006.01) |
| ***E06C 1/383*** | (2006.01) |
| ***E06C 7/50*** | (2006.01) |
| ***E06C 1/10*** | (2006.01) |

(52) U.S. Cl.

CPC . *E06C 1/383* (2013.01); *E06C 7/50* (2013.01); *E06C 1/10* (2013.01)

(58) Field of Classification Search

USPC ..... 182/159, 163

See application file for complete search history.

(56) References Cited

U.S. PATENT DOCUMENTS

| | | | | |
|---|---|---|---|---|
| 341,284 | A * | 5/1886 | sharp | 182/25 |
| 1,004,883 | A * | 10/1911 | Knollenberg | 182/24 |
| 2,875,935 | A * | 3/1959 | Buttermore et al. | 182/160 |
| 3,722,622 | A * | 3/1973 | Lauring | 182/159 |
| 4,463,829 | A * | 8/1984 | Grin | 182/160 |
| 4,612,848 | A * | 9/1986 | Pollack | 454/170 |
| 4,815,564 | A * | 3/1989 | Yoo | 182/160 |
| 5,242,030 | A * | 9/1993 | Lobozzo | 182/187 |
| 5,350,038 | A * | 9/1994 | Lazarus | 182/163 |
| 6,457,559 | B1 * | 10/2002 | Schlueter et al. | 182/159 |
| 6,536,558 | B2 * | 3/2003 | Price | 182/162 |
| 7,140,072 | B2 * | 11/2006 | Leng | 16/326 |
| 7,424,933 | B2 * | 9/2008 | Weiss | 182/163 |
| 8,443,938 | B2 * | 5/2013 | Furseth et al. | 182/159 |
| 2006/0032708 | A1 * | 2/2006 | Welsh | 182/159 |
| 2013/0037350 | A1 * | 2/2013 | Geiselman et al. | 182/108 |

* cited by examiner

*Primary Examiner* — Katherine Mitchell
*Assistant Examiner* — Candace L Bradford
(74) *Attorney, Agent, or Firm* — Stoel Rives LLP

(57) ABSTRACT

Self-locking bi-foldable load bearing segments are disclosed that can be used in applications such as ladders or ramp. First and second sections of the segment are foldably coupled to transition between an open configuration and a folded configuration. The first and second sections can include rungs pivotally attached to rails that can be further transitioned from the folded configuration to a collapsed configuration, but not transitioned from the open configuration to the collapsed configuration. Openings in the side walls of the rails allow the rungs to pivot in one direction, but not an opposite direction. In the open configuration, the openings of the first and second sections may be oriented opposite, and the direction of allowed rotation of the rungs of the first section and second section are opposite, restricting compression of the rails together. In the folded configuration, the openings of the first and second sections can be oriented the same to allow rotation of the rungs and compression of the rails together.

10 Claims, 5 Drawing Sheets

SELF-LOCKING BI-FOLDABLE LOAD BEARING SEGMENT

TECHNICAL FIELD

The present disclosure relates to load bearing segments such as ladders and ramps, and more particularly to foldable load bearing segments.

BACKGROUND

Load bearing segments comprising rails and cross members (e.g., rungs) are utilized in a variety of applications. Examples of load bearing segments may include, but are not limited to, ladders, ramps, scaffolding, and the like. Often the dimensions of a load bearing segment, such as the length and/or the width, can inhibit compact storage and/or easy transport of the load bearing segment. Efforts have been made to design foldable and/or collapsible load bearing segments. The presently available foldable load bearing segments typically include a latch to lock the rails in an open position and thereby preserve the rigidity of the ladder and prevent the rails from moving to a closed position during operation or rely on securement of a portion of the load bearing segment to a rigid structure, such as a wall, in order to limit or inhibit unintended transition from an open position to a closed position, during use.

BRIEF SUMMARY

The present disclosure is directed to a self-locking bi-foldable load bearing segment. The self-locking bi-foldable load bearing segment may include a first section and a second section foldably connected, thereby allowing the load bearing segment to be in an open configuration and a folded configuration, in which the length of the load bearing segment is reduced. Each of the first and second sections may include rails and rungs that may be pivotally attached and may be operated as a parallelogram linkage system. The load bearing segment may be configured such that the width can be reduced to a compressed configuration from the folded configuration, but not from the open configuration. Each of the rails of the first section and of the second section may include openings in a side wall that allow the rungs to pivot in a single direction. In the open configuration, the openings of the rails in the first section may be oriented opposite the openings of the second section, such that the direction of allowed rotation of the rungs of each of the first section and second section are opposite and the rails cannot be moved (e.g., compressed) with respect to one another. In the folded configuration, the openings of the rails in the first section may be oriented the same as the openings of the second section, such that the direction of allowed rotation of the rungs of each of the first section and second section are the same and the rails can be compressed together or otherwise moved (e.g., compressed) with respect to one another to adjust the distance of separation between the rails.

In one embodiment, a self-locking bi-foldable load bearing segment may be configured to bear weight against its face in the open configuration, such that the self-locking load bearing segment can be used as a ramp, for example.

In another embodiment, a self-locking bi-foldable load bearing segment may be configured to bear weight along its length in the open configuration, such that the self-locking load bearing segment can be used in an upright orientation as a ladder, for example.

As can be appreciated, in another embodiment, a self-locking bi-foldable load bearing segment may be configured to bear weight against its face and along its length in the open configuration.

Additional advantages and novel features of the disclosure are set forth in part in the description which follows, and in part will become apparent to those skilled in the art upon examination of the following or may be learned by practice of the disclosure. The advantages of the disclosure may be realized and attained by means of the instrumentalities and combinations particularly pointed out in the appended claims.

BRIEF DESCRIPTION OF THE DRAWINGS

The accompanying drawings, which are incorporated in and form a part of the specification, illustrate an embodiment of the present disclosure and, together with the description, serve to explain the principles of the disclosure. However, the scope of the disclosure should in no way be limited to the embodiment depicted in the drawings. In the drawings.

DETAILED DESCRIPTION

A bi-foldable ladder can be folded to reduce a length of the ladder, for example, by folding in half lengthwise, and folded (e.g., collapsed) to reduce a width of the ladder, for example, by varying the distance between the rails from an open position in an operational state to a closed position in a stored state. Ladders that fold to reduce their width typically include a latch to lock the rails in an open position and thereby preserve the rigidity of the ladder across the width and prevent the rails from moving to a closed position during operation. Other ladders that fold to reduce their width may rely on one rail being secured to a rigid structure, such as a wall, in order to prevent the ladder from inadvertent transition from an open position to a closed position during operation. Other ladders that are foldable to reduce their width may include a locking section at the base to prevent the ladder from folding from an open position to a closed position. Existing foldable ladders are not adapted to be self-locking in an open position, such that the distance between the rails is fixed, without the need of the operator to engage a locking mechanism. Moreover, existing foldable ladders are not adapted to be self-locking while allowing stand alone operation. Furthermore, existing ladders are not configured to bear weight against a face of the ladder so as to be utilized as a ramp, for example.

Figure 1C:
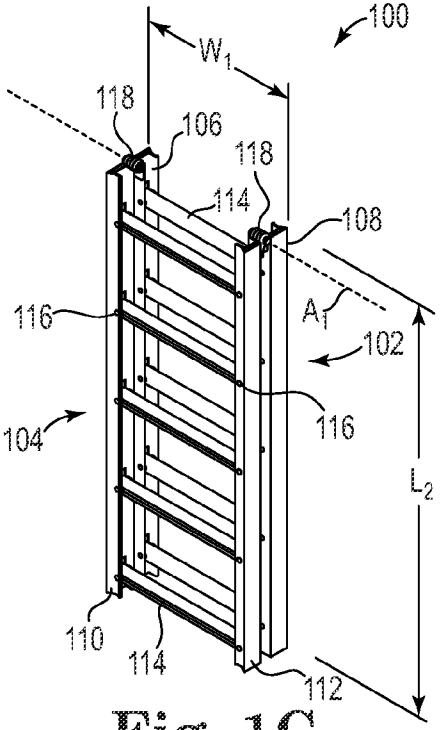
FIG. 1C is a perspective view of a load bearing segment in a folded configuration, according to one embodiment.
Figure 1B:
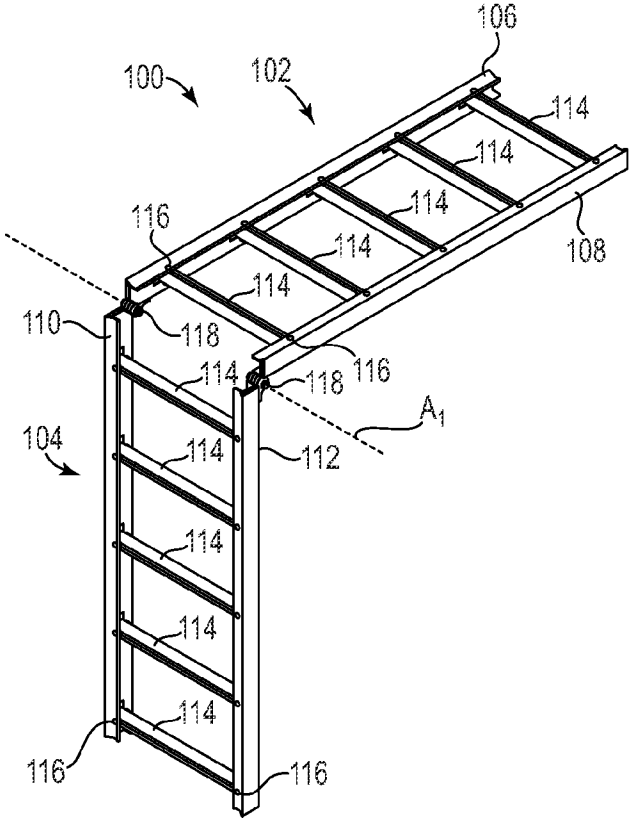
FIG. 1B is a perspective view of a load bearing segment in a partially folded configuration, according to one embodiment.
Figure 1A:
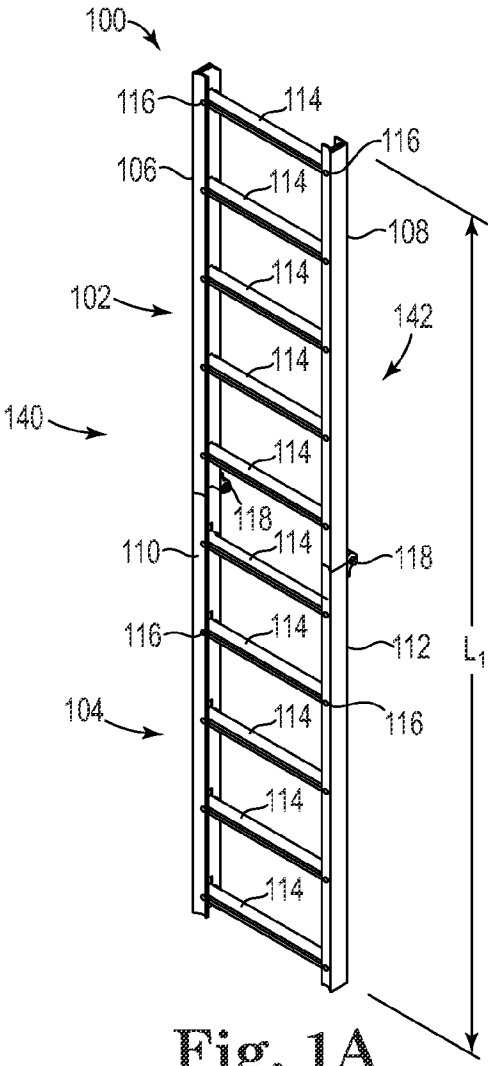
FIG. 1A is a perspective view of a load bearing segment in an open configuration, according to one embodiment.

FIGS. 1A-1C illustrate a load bearing segment 100, according to one embodiment of the present disclosure. Specifically, FIG. 1A is a perspective view of the load bearing segment 100 in an open configuration, FIG. 1B is a perspective view of the load bearing segment 100 in a partially folded configuration, and FIG. 1C is a perspective view of the load bearing segment 100 in a fully folded configuration.

The load bearing segment 100 may include a first section 102 and a second section 104 coupled together by hinges 118, which enable transition from the open configuration of FIG. 1A to a partially folded configuration of FIG. 1B or a folded configuration of FIG. 1C. The load bearing segment 100 can be constructed of any suitable materials capable of bearing a desired load and withstanding the weather elements, such as for example, powder-coated all-weather steel, aluminum, fiber reinforced thermoset resins, natural or engineered wood products, carbon fiber, composite materials, and/or combinations thereof. The first section 102 may include a first rail 106 and a second rail 108 arranged in parallel and coupled together by a first plurality of parallel rungs 114 extending between the rails 106, 108. The rails 106, 108 and rungs 114 of the first section 102 may lie in a plane. This plane may be referred to as the plane of the first section 102. Similarly, the second section 104 may include a third rail 110 and fourth rail 112 arranged in parallel and coupled together by a second plurality of parallel rungs 114. The rails 110, 112 and rungs 114 of the second section 104 may lie in a plane. This plane may be referred to as the plane of the second section 104.

As noted above, the first section 102 may be rotatably coupled to the second section 104 by one or more hinges 118. The first section 102 and the second section 104, in an open configuration as depicted in FIG. 1A, are arranged linearly, end to end, with the plane of the first section 102 in the same plane as the plane of the second section 104, such that the third rail 110 is in line with the first rail 106 and the fourth rail 112 is in line with the second rail 108. In the open configuration, the load bearing segment 100 presents a front face 140 and a rear face 142, each parallel to and/or on opposing sides of the plane in which the rails 106, 108, 110, 112 and the rungs 114 lie. The plane in which the plane of the first section 102 and the plane of the second section 104 lie in the open configuration may be referred to as the plane of the load bearing segment. In the illustrated load bearing segment 100, the front face 140 may be positioned on the side of the plane of the load bearing segment 100 opposite the hinges and the rear face 142 may be positioned on the same side of the plane of the load bearing segment 100 as the hinges.

As shown in FIGS. 1B and 1C, the second section 104 is configured to rotate about an axis Al that lies in, or parallel to, the plane of the load bearing segment. A transition from the open configuration of FIG. 1A to a fully folded configuration of FIG. 1C reduces a length L1 of the load bearing segment. In the illustrated embodiment, the fully folded configuration has a length L2 that is approximately half of length L1. In a partially folded configuration, such as is illustrated in FIG. 1 B, the plane of the first section 102 intersects the plane of the second section 104. In a fully folded configuration, such as is illustrated in FIG. 1C, the plane of the first section 102 may be approximately parallel to the plane of the second section 104, although reversed in orientation as compared to the open configuration.

In the illustrated embodiment, the first rail 106, the second rail 108, the third rail 110, and fourth rail 112 may be formed from extruded aluminum. The rails 106, 108, 110, 112 may be extruded to have a "C-shaped" cross section, as shown in FIG. 7A and described below with reference to the same. As can be appreciated, in other embodiments, the rails 106, 108, 110, 112 can be formed of any suitable material having sufficient rigidity and/or structure to support a desired load, including but not limited to powder-coated all-weather steel, aluminum, fiber reinforced thermoset resins, natural or engineered wood products, carbon fiber, composite materials, and/or combinations thereof.

In the illustrated load bearing segment 100, the plurality of rungs 114 can be constructed of steel or aluminum tubing or an aluminum extrusion. However, as can be appreciated, in other embodiments the rungs 114 can be formed of any suitable material having sufficient rigidity and/or structure to support a desired load, including but not limited to powder-coated all-weather steel, aluminum, fiber reinforced thermoset resins, natural or engineered wood products, carbon fiber, composite materials, and/or combinations thereof.

The rungs 114 may be pivotally attached to the first rail 106 and the second rail 108, or the third rail 110 and the fourth rail 112 using rivets 116. Alternatively, the rungs 114 can be fastened to the first rail 106 and the second rail 108, or the third rail 110 and the fourth rail 112, using a nut and bolt combination. In other embodiments, the rungs 114 can be fastened to rails 106, 108, 110, 112 utilizing a pin and clip. In still other embodiments, the rungs can be fastened to the rails 106, 108, 110, 112 utilizing any fastener or securement device that allows the rungs 114 to be pivotally coupled to and to rotate relative to the rails 106, 108, 110, 112.

The rungs 114 (both the first plurality of rungs 114 of the first section 102 and the second plurality of rungs 114 of the second section 104) may be configured approximately in parallel to each other and aligned to intersect the rails 106, 108, 110, 112. In the open configuration, the rungs 114 may be oriented approximately orthogonal to the rails 106, 108, 110, 112. As can be appreciated, how precisely parallel the rungs 114 lie relative to each other and how precisely orthogonal the rungs are to the rails 106, 108, 110, 112 may depend on various factors, but generally the degree of deviation is relatively small, for example, less than an angle of 10 degrees. As described more fully below, the first rail 106 and second rail 108 may be configured to allow the first plurality of rungs 114 to rotate only a first direction from an approximately orthogonal position relative to the rails 106, 108 and the third rail 110 and fourth rail 112 may be configured to allow the second plurality of rungs 114 to rotate only a second direction, opposite the first direction, from an approximately orthogonal position relative to the rails 110, 112.

For example, looking at the front face 140 of the load bearing segment 100 in the open configuration, the rungs 114 may be positioned perpendicular to the rails 106, 108, 110, 112. The first rail 106 and second rail 108 may restrict rotation of the first plurality of rungs 114 to rotation in a clockwise direction relative to the front face of the load bearing segment 100. The third rail 110 and fourth rail 112 may restrict rotation of the second plurality of rungs 114 to rotation in a counterclockwise relative to the front face 140 of the load bearing segment. Thus, the restricted range of rotation of the first plurality of rungs 114 also restricts rotation of the second plurality of rungs, and vice versa, when the load bearing segment is in the open configuration. In this manner, a width of the load bearing segment 100 is automatically locked and secured in a fixed position in the open configuration. There is no need for a separate locking mechanism to lock the position of the rungs 114 to prevent undesired rotation of the rungs 114 when the load bearing segment is in use.

As can be appreciated, restriction of rotation of the rungs 114 to a single direction relative to the rails 106, 108, 110, 112 may be accomplished by a configuration of the rungs 114, or a combination of a configuration of the rails 106, 108, 110, 112 and the rungs 114, rather than simply the configuration of the rails 106, 108, 110, 112 alone. One example of how restriction of rotation of the rungs 114 is accomplished is described below with reference to FIGS. 5A, 5B, 6A, and 6B.

When the load bearing segment 100 is in a fully folded configuration, as shown in FIG. 1C, the pivotal attachment of the rungs 114 to the first rail 106 and the second rail 108 in the first section 102 and to the third rail 110 and the fourth rail 112 in the second section 104 may enable the load bearing segment 100 to operate similar to a parallelogram linkage system. With the load bearing segment 100 in a fully folded configuration, the direction of allowed rotation of the first plurality of rungs 114 of the first section 102 may be the same relative direction of the direction of allowed rotation of the second plurality of rungs 114 of the second section 104. Folding the load bearing beam 100 results in the plane of the second section 104 reversing, which also reverses the direction of allowed rotation of the second plurality of rungs 114 relative to the plane of the first section 102. Because the direction of allowed rotation of the first and second plurality of rungs 114 is the same, the load bearing segment 100 can now be folded a second time to reduce the width. The second fold may be accomplished by rotating the rungs 114 relative to the rails 106, 108, 110, 112 from an orthogonal position of the open configuration to a position forming a relatively small angle between the rungs 114 and the rails 106, 108, 110, 112 in the compressed configuration, as shown in FIGS. 2A, 2B, 3A, and 3B.

Figure 3B:
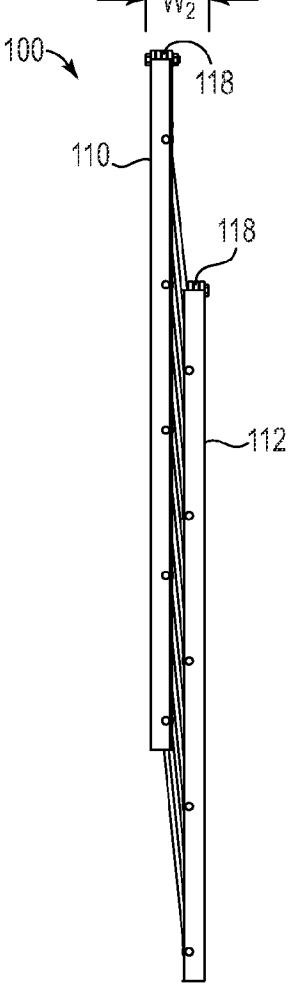
FIG. 3B is a front view of a load bearing segment in a fully compressed configuration, according to one embodiment.
Figure 3A:
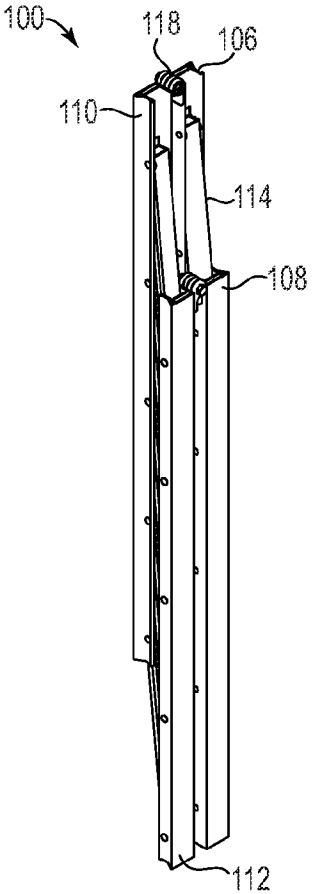
FIG. 3A is a perspective view of a load bearing segment in a fully compressed configuration, according to one embodiment.
Figure 2B:
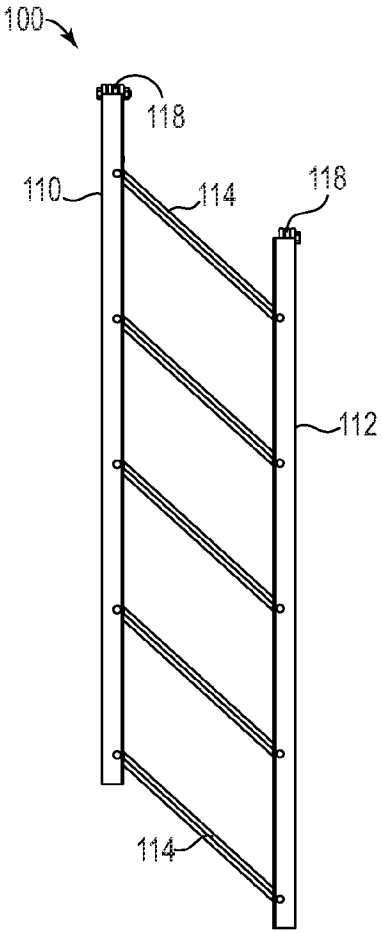
FIG. 2B is a front view of a load bearing segment in a partially compressed configuration, according to one embodiment.
Figure 2A:
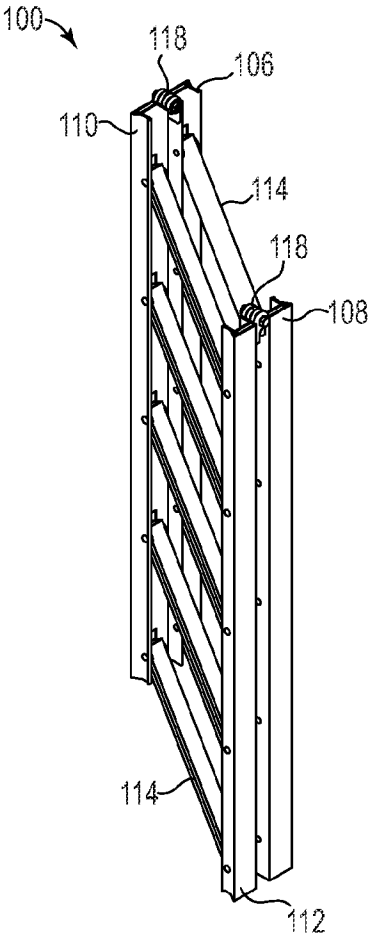
FIG. 2A is a perspective view of a load bearing segment in a partially compressed configuration, according to one embodiment.

FIG. 2A is a perspective view of the load bearing segment 100 in a partially compressed configuration, according to one embodiment. FIG. 2B is a front view of the load bearing segment 100 in a partially compressed configuration, according to one embodiment. FIG. 3A is a perspective view of the load bearing segment 100 in a fully compressed configuration, according to one embodiment. FIG. 3B is a front view of the load bearing segment 100 in a fully compressed configuration, according to one embodiment. FIGS. 2A, 2B, 3A, and 3B illustrate a transition of the load bearing segment 100 from the folded configuration to the collapsed configuration. In particular, the second rail 108 and the fourth rail 112 move respectively toward the first rail 106 and third rail 110 as the rungs 114 rotate relative to the rails 106, 108, 110, 112. FIG. 2 illustrates a partially collapsed configuration while FIGS. 3A and 3B illustrate the fully collapsed configuration. In the fully collapsed configuration, as shown in FIG. 3A, the first rail 106 and second rail 108 of first section 102 and the third rail 110 and fourth rail 112 of second section 104 are a relatively minimal distance apart. Thus, the width W1 (see FIG. 1C) of the load bearing segment 100 in the open configuration or folded configuration is reduced to a smaller width W2 (see FIG. 3B), which may be a fraction of the width W1. In the collapsed position the load bearing segment 100 can be more easily transported and/or stored.

The angle between the rungs 114 and the rails 106, 108, 110, 112 in the compressed configuration may be, for example, less than 30 degrees. In another embodiment, the angle may be less than 25 degrees. In another embodiment, the angle may be less than 20 degrees. In still another embodiment, the angle may be less than 15 degrees. In another embodiment, the angle may be less than 10 degrees. In still another embodiment, the angle may be less than 5 degrees. The distance between the second rail 108 of first section 102 and the third rail 110 and fourth rail 112 of second section 104 may be a fraction of the size (e.g., length) of the rungs 114 (or a fraction of the width of the load bearing segment 100 in the open configuration).

Figure 4B:
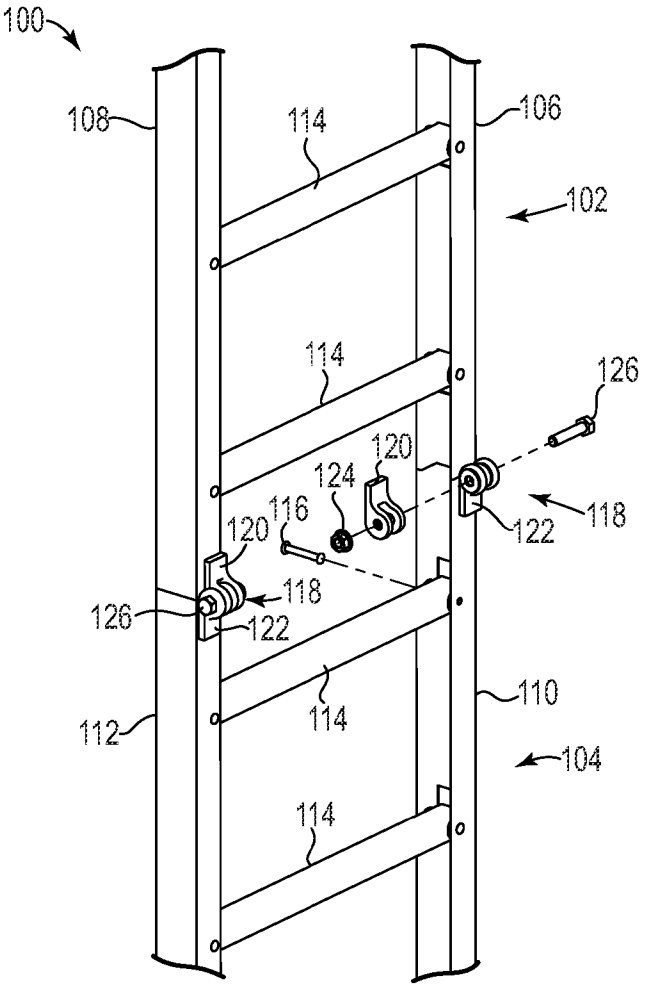
FIG. 4B is a rear view of a detailed explosion illustrating the fastener and hinge arrangement of a load bearing segment, according to one embodiment.
Figure 4A:
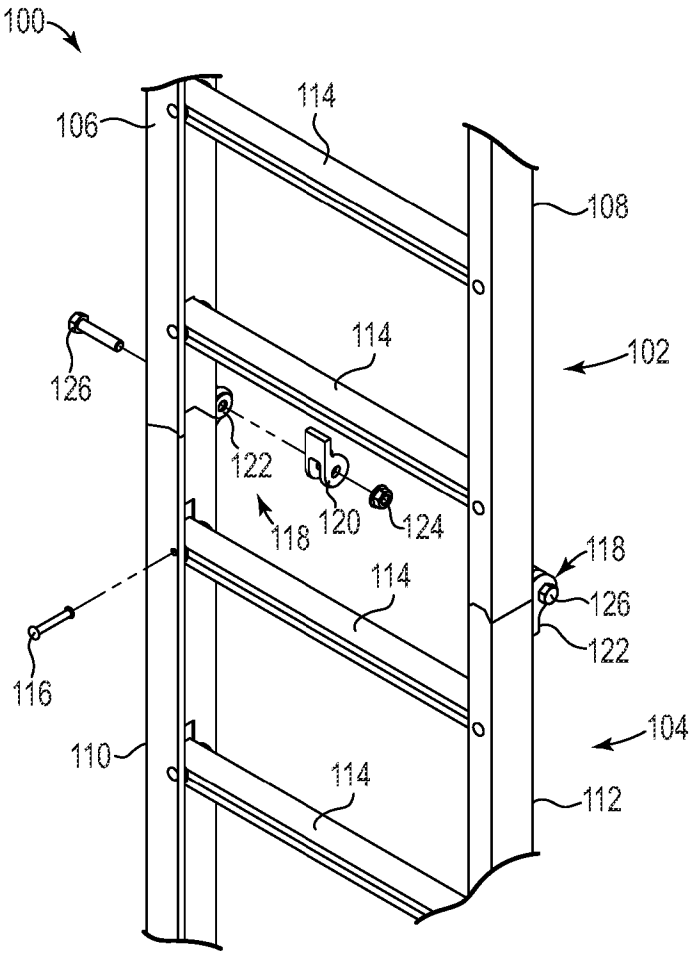
FIG. 4A is a front view of a detailed explosion illustrating the fastener and hinge arrangement of a load bearing segment, according to one embodiment.

FIGS. 4A and 4B illustrate an exploded view of the hinges 118. Each hinge 118 may include a first piece 120 attached to the first section 102 and a second piece 122 attached to the second section 104. In the exemplary embodiment, the first piece 120 and the second piece 122 may be welded to the first section 102 and the second section 104, respectively, but can be attached using other well known methods. The first piece 120 and the second piece 122 may be configured to fit within one another, or otherwise matingly couple, and may be connected using, for example, a nut 124 and bolt 126 combination. The hinges 118 may allow the first section 102 and the second section 104 to be moved (e.g., rotated) with respect to one another from the open configuration shown in FIG. 1A to the folded configuration shown in FIG. 1C. It should be noted that the hinges 118 can comprise other known hinge configurations, such as those disclosed in U.S. Pat. No. 6,866,117, which is hereby incorporated herein by reference.

Figure 5A:
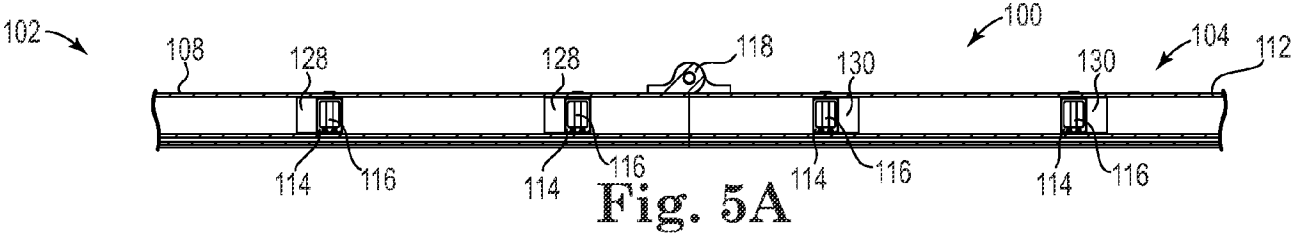
FIG. 5A is a side view of a load bearing segment in an open configuration, according to one embodiment.
Figure 5B:
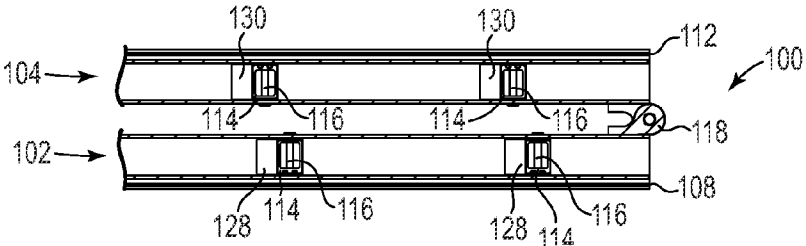
FIG. 5B is a side view of a load bearing segment in a folded configuration, according to one embodiment.
Figure 6A:
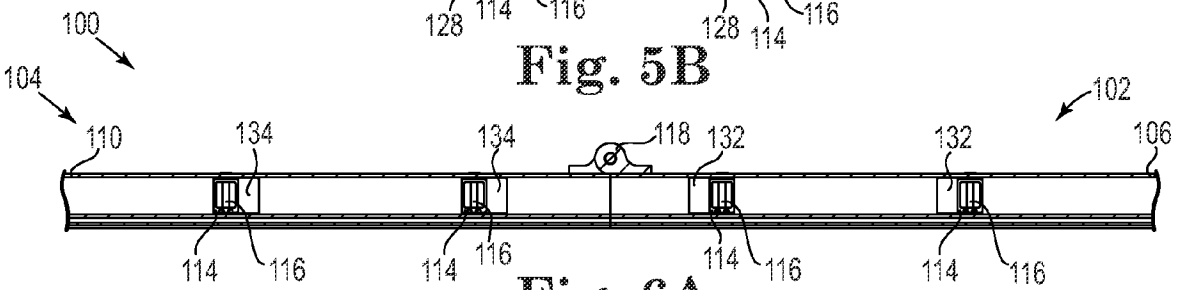
FIG. 6A is a side view of a load bearing segment in an open configuration, according to one embodiment.
Figure 6B:
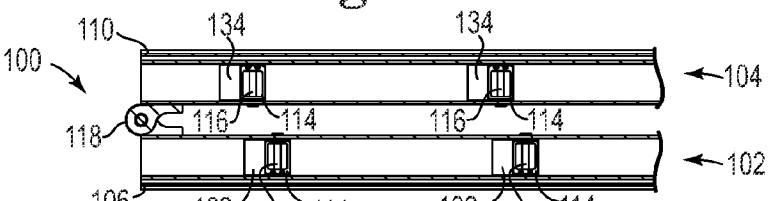
FIG. 6B is a side view of a load bearing segment in a folded configuration, according to one embodiment.

FIG. 5A is a side view of load bearing segment 100 in the open configuration, according to one embodiment. FIG. 5B is a side view of the load bearing segment 100 in the folded configuration, according to one embodiment. FIG. 6A is a side view of the load bearing segment 100 in the open configuration, showing the side of the load bearing segment 100 opposite the side shown in FIG. 5A. FIG. 6B is a side view of load bearing segment 100 in the folded configuration, showing the side of the load bearing segment 100 opposite the side shown in FIG. 5B. As described more fully below with reference to FIG. 7A and 7B, the rails 106, 108, 110, 112 may comprise an inner wall 704 and an outer wall 706 (see FIGS. 7A, 7B). In FIGS. 5A, 5B, 6A, and 6B, the outer wall 706 is transparent in order to illustrate the operation and/or configuration of the rungs 114 and rails 106, 108, 110, 112 of the load bearing segment 100. The inner wall 704 may include openings configured to accommodate rotation of the rungs 114 in one direction while limiting or restricting rotation of the rungs 114 in an opposite direction at a point where the rungs 114 are oriented approximately orthogonal to the rails 106, 108, 110, 112.

For example, as shown in FIGS. 5A and 5B, the second rail 108 may include openings 128 in the inner wall 704 that are configured to accommodate rotation of a center portion of the rungs 114 toward the hinge 118 (and in turn accommodate rotation of the ends of the rungs 114 secured to the second rail 108 away from the hinge 118), relative to the second rail 108, about the axis of the respective rivets 116, when the load bearing segment 100 is in the folded configuration. Similarly, the fourth rail 112 may also include openings 130 in the inner wall 704 that are configured to accommodate rotation of a center portion of the rungs 114 toward the hinge 118 (and in turn rotation of the ends of the rungs 114 secured to the fourth rail 112 away from the hinge 118), relative to the fourth rail 112, about the axis of the respective rivets 116, when the load bearing segment 100 is in the folded configuration. Thus, in the illustrated embodiment, the center portions of the rungs 114 rotate towards the hinge 118 relative to the second rail 108 and fourth rail 112 and the ends of the rungs 114 secured to the second rail 108 and the fourth rail 112 rotate away from the hinge 118.

As shown in FIGS. 6A and 6B, the first rail 106 may include openings 132 in the inner wall 704 that are configured to accommodate rotation of the center portion of the rungs 114 away from the hinge 118 (and in turn accommodate rotation of the ends of the rungs 114 secured to the first rail 106 towards the hinge 118), relative to the first rail 106, about the axis of the respective rivets 116, when the load bearing segment 100 is in the folded configuration. Similarly, the third rail 110 may also include openings 134 in the inner wall 704 that are configured to accommodate rotation of the center portion of the rungs 114 away from the hinge 118 (and in turn accommodate rotation of the ends of the rungs 114 secured to the third rail 110 towards the hinge 118) relative to the third rail 110, about the axis of the respective rivets 116, when the load bearing segment 100 is in the folded configuration. The configuration of the openings on respective rails may restrict or prevent the load bearing segment 100 from collapsing (e.g. may prevent reduction of the width W1) when the load bearing segment 100 is in the open configuration. Stated differently, the rung 114 and opening 128, 132 configurations of first the section 102 inhibit the rotation of the rungs 114 of the second section 104. Similarly, the rungs 114 and opening 130, 134 configurations of the second section 104 inhibit rotation of the rungs 114 of the first section 102.

As depicted in FIG. 5A, rotation of the center portions of the rungs 114 is restricted to rotation towards the hinge 118, which is to the right in the figure for the first plurality of rungs 114 of the first section 102 and to the left in the figure for the second plurality of rungs 114 of the second section 104. As depicted in FIG. 6A, rotation of the center portions of the rungs 114 is restricted to rotation away from the hinge 118, which is to the right in the figure for the first plurality of rungs 114 of the first section 102 and to the left in the figure for the second plurality of rungs 114 of the second section 104. The opposing directions of allowed rotation (and directions of restricted rotation) of the first section 102 and the second section 104, in the open configuration, restrict or prevent all rotation of the rungs 114, thus automatically locking the rungs 114 and the load bearing segment 100 against collapse along the width of the load bearing segment 100. Only when load bearing segment 100 is in the folded configuration, as shown in FIGS. 5B and 6B, can the distance between first rail 106 and second rail 108 of first section 102 and the distance between third rail 110 and fourth rail 112 of second section 104 be varied. Thus, the width of the load bearing segment 100 is "locked" by virtue of the load bearing segment being in the open configuration.

Once the load bearing segment 100 is in a folded configuration the width of the load bearing segment can be reduced. In the folded configuration, the direction of allowed rotation of the rungs of the first section 102 and the direction of allowed rotation of the rungs of the second section 104 are the same relative to each other (e.g., the center of the rungs can rotate toward the hinge 118, to the right in FIG. 5B and to the left in FIG. 6B). Further, the configuration of the openings 128, 130, 132, 134 may allow the load bearing segment 100 to only be collapsed in one direction from the folded configuration. For example, the first rail 106 and the third rail 110 collapse in a direction toward the hinges 118 and the second rail 108 and the fourth rail 112 collapse in a direction away from the hinges 118. In the collapsed configuration, the hinge 118 coupling the first rail 106 and the third rail 110 is positioned above the hinge 118 coupling the second rail 108 and the fourth rail 112 (or more toward an end of the load bearing segment 100), as shown in FIGS. 3A and 3B.

In the illustrated embodiment, each end of the rungs 114 is configured to be disposed within and/or through the respective openings 128, 130, 132, 134 in the rails 106, 108, 110, 112. Each end of each of the rungs 114 can rotate unimpeded toward a center of the respective opening 128, 130, 132, 134 when the rung is rotated in one of the first direction of rotation or the second direction of rotation. For example, a first plurality of rungs 114 coupled to the first rail 106 and the second rail 108 may be disposed within or through the openings 132 of the first rail 106 and disposed within or through the openings 128 of the second rail 108. The openings 128, 132 may be configured such that the first plurality of rungs 114 can rotate, for example, in a first direction relative to the hinges 118. The first plurality of rungs 114 may be coupled to the first rail 106 adjacent an edge of the openings 132 such that the end of each of the first plurality of rungs 114 that is disposed within or through the opening 132 can rotate unimpeded toward a center of the opening 132 and such that rotation of each of the first plurality of rungs 114 in an opposite direction is impeded by abutment of the end of the rung 114 with the edge of the opening 132 at a position where the first plurality of rungs 114 are all approximately perpendicular to the first rail 106 and the second rail 108.

The first plurality of rungs 114 also may be coupled to the second rail 108 adjacent an edge of the openings 128 such that the end of each of the first plurality of rungs 114 disposed within or through the opening 128 can rotate unimpeded toward a center of the opening 128 and such that rotation of each of the first plurality of rungs 114 in an opposite direction is impeded by abutment of the end of the rung 114 with the edge of the opening 128 at a position where the first plurality of rungs 114 are all approximately perpendicular to the first rail 106 and the second rail 108.

Similarly, a second plurality of rungs 114 coupled to the third rail 110 and the fourth rail 112 may be disposed within or through the openings 134 of the third rail 110 and disposed within or through the openings 130 of the fourth rail 112. The openings 130, 134 may be configured such that the second plurality of rungs 114 can rotate, for example, in a second direction relative to the hinges 118. The second plurality of rungs 114 may be coupled to the third rail 110 adjacent an edge of the openings 134 such that the end of each of the second plurality of rungs 114 that is disposed within or through the opening 134 can rotate unimpeded toward a center of the opening 134 and such that rotation of each of the second plurality of rungs 114 in an opposite direction is impeded by abutment of the end of the rung 114 with the edge of the opening 134 at a position where the second plurality of rungs 114 are all approximately perpendicular to the third rail 110 and the fourth rail 112.

The second plurality of rungs 114 also may be coupled to the fourth rail 112 adjacent an edge of the openings 130 such that the end of each of the second plurality of rungs 114 disposed within or through the opening 130 can rotate unimpeded toward a center of the opening 130 and such that rotation of each of the second plurality of rungs 114 in an opposite direction is impeded by abutment of the end of the rung 114 with the edge of the opening 130 at a position where the second plurality of rungs 114 are all approximately perpendicular to the third rail 110 and the fourth rail 112.

Figure 7B:
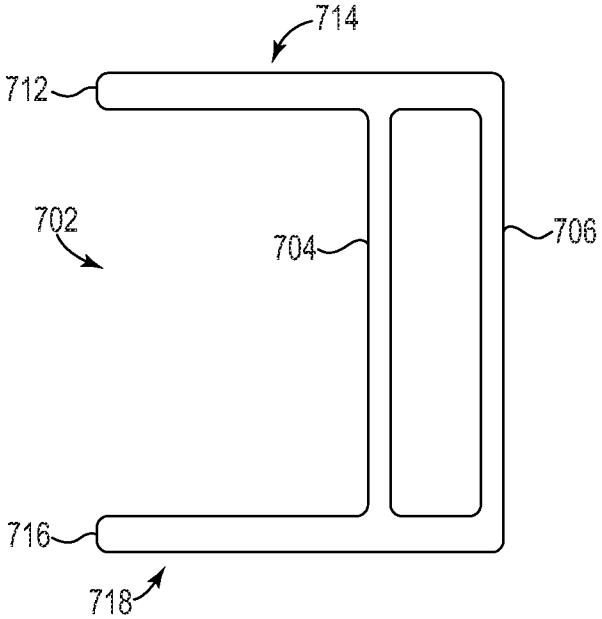
FIG. 7B illustrates an end view of a load bearing segment rail, according to another embodiment.
Figure 7A:
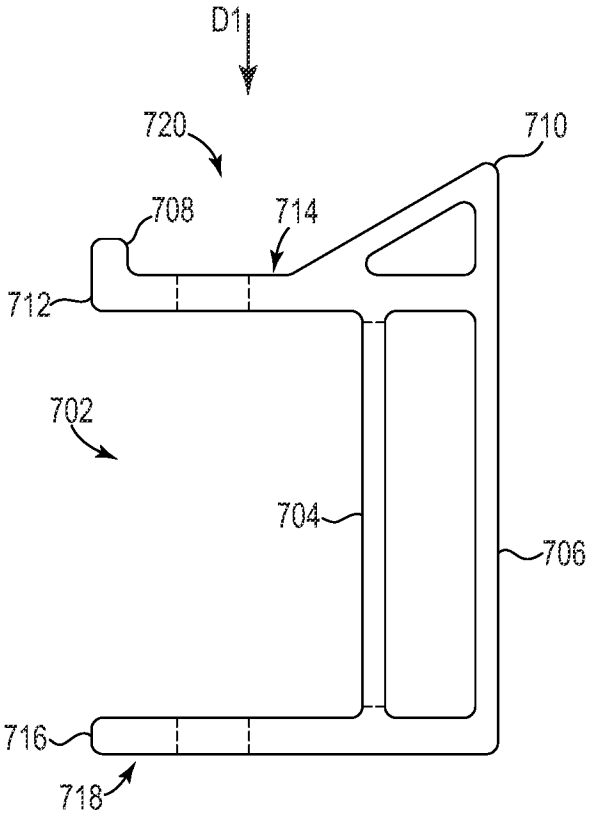
FIG. 7A illustrates an end view of a load bearing segment rail, according to one embodiment.

FIGS. 7A and 7B are end views of embodiments of rails 106, 108, 110, 112. Specifically, FIG. 7A illustrates an end view of a rail 106, 108, 110, 112 of a ramp, according to one embodiment. FIG. 7B illustrates an end view of a rail 106, 108, 110, 112 of a ladder, according to another embodiment. The end views show the transverse cross sections of the embodiments of a rail 106, 108, 110, 112. The transverse cross section of each of the rails 106, 108, 110, 112 may include a "C-shaped" channel 702, an inner wall 704, and an outer wall 706. The channel 702 may be formed by a front protrusion 712 that defines a front face 714 of the rail and a rear protrusion 716 defining a rear face 718 of the rail. The channel may be configured to receive ends of a plurality of rungs 114 between the front protrusion 712 and the rear protrusion 716.

The outer wall 706 may serve to prevent the ends of rungs 114 from creating user "pinch" points when the rungs 114 are moved relative to the respective openings in the inner wall 704. The outer wall 706 may shield a user from contact with the ends of the rungs 114 through the openings 128, 130, 132, 134, in the inner wall 704 of the rails 106, 108, 110, 112.

The cross section may also include a tab 708 and a flange 710. The tab 708 and the flange 710 may be positioned on the front face 714 and define a recess 720 for the rivets 116. (A perspective view of the recess can be seen in FIG. 4A, although it is not designated). The head of each rivet 116 does not extend or protrude beyond the tab 708. The flange 710 may provide additional support and/or structure to strengthen the rails 106, 108, 110, 112 and to the load bearing segment 100. The flange 710 may also serve to direct objects toward the center of the load bearing segment 100.

The cross section shown in FIG. 7A may be utilized in a horizontal load bearing segment 100 such as would be useful in a ramp application, where weight would be placed, or a force exerted, in a direction D1 against the front face 714 of the rail 106. In the illustrated embodiment, direction D1 is downward in FIG. 7A (i.e., on a top of the cross section, on a front face 140 of the load bearing segment 100). The cross section shown in FIG. 7B may be utilized in a vertical load bearing segment 100, such as would be useful for a ladder application. A load would be applied in a direction into or out of the page of the drawing of FIG. 7B.

Where a range of values is provided, it is understood that each intervening value, to the tenth of the unit of the lower limit unless the context clearly dictates otherwise, between the upper and lower limit of that range and any other stated or intervening value in that stated range is encompassed within the disclosure. The upper and lower limits of these smaller ranges, which may independently be included in the smaller ranges, is also encompassed within the disclosure, subject to any specifically excluded limit in the stated range. Where the stated range includes one or both of the limits, ranges excluding either both of those included limits are also included in the disclosure.

Unless defined otherwise, all technical and scientific terms used herein have the same meaning as commonly understood by one of ordinary skill in the art to which this disclosure belong. Although any methods and materials similar or equivalent to those described herein can also be used in the practice or testing of the disclosure, the preferred methods and materials are now described. All patents and publications mentioned herein, including those cited in the Background of the application, are hereby incorporated by reference to disclose and described the methods and/or materials in connection with which the publications are cited.

The publications discussed herein are provided solely for their disclosure prior to the filing date of the present application. Nothing herein is to be construed as an admission that the present disclosure are not entitled to antedate such publication by virtue of prior invention. Further, the dates of publication provided may be different from the actual publication dates which may need to be independently confirmed.

Other embodiments of the present disclosure are possible. Although the description above contains much specificity, these should not be construed as limiting the scope of the disclosure, but as merely providing illustrations of some of the presently preferred embodiments of this disclosure. It is also contemplated that various combinations or sub-combinations of the specific features and aspects of the embodiments may be made and still fall within the scope of this disclosure. It should be understood that various features and aspects of the disclosed embodiments can be combined with or substituted for one another in order to form various embodiments. Thus, it is intended that the scope of at least some of the present disclosure should not be limited by the particular disclosed embodiments described above.

Thus the scope of this disclosure should be determined by the appended claims and their legal equivalents. Therefore, it will be appreciated that the scope of the present disclosure fully encompasses other embodiments which may become obvious to those skilled in the art, and that the scope of the present disclosure is accordingly to be limited by nothing other than the appended claims, in which reference to an element in the singular is not intended to mean "one and only one" unless explicitly so stated, but rather "one or more." All structural, chemical, and functional equivalents to the elements of the above-described preferred embodiment that are known to those of ordinary skill in the art are expressly incorporated herein by reference and are intended to be encompassed by the present claims. Moreover, it is not necessary for a device or method to address each and every problem sought to be solved by the present disclosure, for it to be encompassed by the present claims. Furthermore, no element, component, or method step in the present disclosure is intended to be dedicated to the public regardless of whether the element, component, or method step is explicitly recited in the claims.

The foregoing description of various preferred embodiments of the disclosure have been presented for purposes of illustration and description. It is not intended to be exhaustive or to limit the disclosure to the precise embodiments, and obviously many modifications and variations are possible in light of the above teaching. The example embodiments, as described above, were chosen and described in order to best explain the principles of the disclosure and its practical application to thereby enable others skilled in the art to best utilize the disclosure in various embodiments and with various modifications as are suited to the particular use contemplated. It is intended that the scope of the disclosure be defined by the claims appended hereto.

What is claimed is:

1. A self-locking, bi-folding load bearing segment, the load bearing segment comprising:

a first section comprising a first rail, a second rail, and a first plurality of hollow tubular rungs pivotally attached to and extending between the first and second rails in a parallelogram linkage, such that a separation between the first and second rails is adjustable between an un-collapsed configuration with the rungs generally perpendicular to the first and second rails and a collapsed configuration with the rungs at an angle of less than 30 degrees relative to the first and second rails, the first and second rails restricting rotation of the first plurality of rungs from the un-collapsed to the collapsed configuration to a first direction relative to a front face of the load bearing segment;

a second section comprising a third rail, a fourth rail, and a second plurality of rungs pivotally attached to and extending between the third and fourth rails in a parallelogram linkage, such that a separation between the third and fourth rails is adjustable between the un-collapsed configuration with the rungs generally perpendicular to the third and fourth rails and the un-collapsed configuration with the rungs at an angle of less than 30 degrees relative to the third and fourth rails, the third and fourth rails restricting rotation of the second plurality of rungs from the un-collapsed to the collapsed configuration to a second direction opposite the first direction relative to the front face of the load bearing segment;

a first hinge pivotally attaching the first ladder rail to the third ladder rail; and a second hinge pivotally attaching the second ladder rail to the fourth ladder rail, wherein the first and second hinges allow the first and second sections to be rotated between an open configuration to the folded configuration, wherein the first and second plurality of rungs on the first and second segments rotate in the same direction relative to the rails when in the folded configuration to permit the rails to be moved between the un-collapsed configuration to the collapsed configuration, and wherein the first and second plurality of rungs on the first and second segments rotate in opposite directions when in the open configuration to automatically lock the first and second segments in the un-collapsed configuration, wherein no separate locking mechanism is required to lock the first and second plurality of rungs in the un-collapsed configuration when the load bearing segment is in the open configuration.

2. The load bearing segment of claim 1 wherein each of the first rail, the second rail, the third rail, and the fourth rail comprise an inner wall configured to engage the rungs and an outer wall configured to shield a user from contact with ends of the rungs.

3. The load bearing segment of claim 1 comprising openings in the inner walls of the rails that restrict rotation of a plurality of the rungs between the un-collapsed configuration and the collapsed configuration.

4. The load bearing segment of claim 3 each rung engages with at least one opening in the inner walls of the rails.

5. The load bearing segment of claim 1 wherein the rails comprise an inner wall and an outer wall that shields a user from where the rungs engage the inner walls.

6. The load bearing segment of claim 1 wherein the open configuration of the load bearing segment is load bearing in a direction against the front face of the rails and the rungs.

7. The load bearing segment of claim 1 wherein the load bearing segment is load bearing in a direction parallel to a longitudinal axis of the rails in the open configuration.

8. The load bearing segment of claim 1 wherein the load bearing segment is one of a ladder or a ramp.

9. The load bearing segment of claim 1 wherein the rails comprise a "C-shape" cross section with a channel oriented to receive ends of the rungs.

10. The load bearing segment of claim 1 wherein each of the rails comprise one or more tabs protruding out from the front surface of the rail to define a recess on the front surface in which a securement device for securing the rungs to the rail is recessed.

* * * * *